US007980883B2

(12) United States Patent
Lee et al.

(10) Patent No.: US 7,980,883 B2
(45) Date of Patent: Jul. 19, 2011

(54) CONNECTING BLOCK IMPROVED IN CROSSTALK-CHARACTERISTICS

(75) Inventors: Dong-Eun Lee, Incheon (KR); Jong-Seb Baeck, Daegu (KR); Young-Il Cho, Seoul (KR); Su-Jong Kim, Gumi-Si (KR)

(73) Assignee: LS Cable Ltd., Anyang-si, Gyeonggi-do (KR)

( * ) Notice: Subject to any disclaimer, the term of this patent is extended or adjusted under 35 U.S.C. 154(b) by 0 days.

(21) Appl. No.: 12/813,641

(22) Filed: Jun. 11, 2010

(65) Prior Publication Data

US 2010/0317221 A1 Dec. 16, 2010

(30) Foreign Application Priority Data

Jun. 11, 2009 (KR) ..... 10-2009-0051894

(51) Int. Cl.
*H01R 11/20* (2006.01)
*H01R 4/24* (2006.01)
*H01R 4/26* (2006.01)

(52) U.S. Cl. ..... 439/404; 439/941

(58) Field of Classification Search ..... 439/402, 439/404, 403, 405, 941, 942
See application file for complete search history.

(56) References Cited

U.S. PATENT DOCUMENTS 6,346,005 B1 * 2/2002 Viklund et al. ..... 439/404
7,121,870 B1 * 10/2006 Chen ..... 439/404
7,322,847 B2 * 1/2008 Hashim et al. ..... 439/403

* cited by examiner

*Primary Examiner* — Javaid Nasri
(74) *Attorney, Agent, or Firm* — Sherr & Vaughn, PLLC

(57) ABSTRACT

A connecting block includes a housing having a plurality of slots extending from an upper surface thereof to an inside thereof with intervals, a plurality of terminal pins installed in the slots, a dielectric cover made of an insulating resin and coupled to the housing to cover a side of the housing, and a coupling pin electrically contacted with a terminal pin of any one pair among terminal pins belonging to different terminal pin pairs and extending opposite to a terminal pin of the other pair. The coupling pin is molded in a body of the dielectric cover such that the insulating resin is interposed between the coupling pin and the terminal pin opposite to the coupling pin.

6 Claims, 6 Drawing Sheets

CONNECTING BLOCK IMPROVED IN CROSSTALK-CHARACTERISTICS

CROSS-REFERENCE TO RELATED APPLICATION

This application claims priority under 35 USC 119(a) to Korean Patent Application No 10-2009-0051894 filed in Republic of Korea on Jun. 11, 2009, the entire contents of which are incorporated herein by reference.

BACKGROUND OF THE INVENTION

1. Field of the Invention

The present invention relates to a connecting block for connection of a communication cable, and more particularly to a connecting block having a coupling pin for reducing crosstalk between pairs of terminal pines or alien crosstalk between connecting blocks.

2. Description of the Related Art

Generally, a connecting block having a plurality slots for the insertion of conducive wires and a plurality of terminal pins corresponding thereto is installed in a communication terminal box for the purpose of wiring of communication cables such as UTP cable.

A connecting block, known as '110 block' in the art, includes an insulator housing and an IDC (Insulation Displacement Connection) terminal pin installed in the housing.

The housing is provided in a block form in which slots into which conductive wires of a communication cable may be inserted, are repeatedly formed at regular intervals. The housing is configured such that 8 slots are arranged in a line in correspondence with 4 pairs of conductive wires provided in the UTP cable.

The IDC terminal pin has a blade structure, which is diverged into two branches, such that, when a conductive wire of a communication cable is inserted therein, a coating of the conductive wire may be cut. The IDC terminal pin is installed to every slot formed in the housing, and each IDC terminal pin is arranged such that a groove with the blade structure diverged into two branches is accorded with the slot of the housing.

Generally, the connecting block is used in a state that a plurality of housings are connected in series on a base block.

However, in a conventional connecting block, crosstalk occurs between IDC terminal pins in the housing when a communication cable is connected thereto, and alien crosstalk occurs between IDC terminal pins of adjacent blocks, thereby causing loss of signal power.

To solve this problem, there have been proposed techniques of designing IDC terminal pins to have a sufficiently great gap or crossing IDC terminals in pair.

For example, U.S. Pat. No. 6,346,005 discloses that IDC terminal pin pairs have a great gap between them, and a barrier is added between the pairs for electric shielding.

U.S. Pat. No. 7,322,847 discloses a structure in which a lower end of each IDC terminal pin is offset from its upper end so as to cross IDC terminal pins of each pair from each other.

U.S. Pat. No. 7,121,870 discloses that a substantial capacitor structure is formed using an extending conductor between adjacent IDC pair to electrical couple the pairs.

However, the connecting system disclosed in U.S. Pat. No. 6,346,005 has a drawback in that an overall size of the block is seriously increased. Also, the connecting block disclosed in U.S. Pat. No. 7,322,847 has a drawback in that the structure of IDC terminal pin should be changed, resulting in back compatibility with existing products.

In case of the IDC terminal assembly disclosed in U.S. Pat. No. 7,121,870, the extending conductor used for coupling is integrated with IDC, so an assembling work is not easy. In addition, there is limit in that align crosstalk between blocks cannot be reduced. In addition, the IDC terminal assembly disclosed in U.S. Pat. No. 7,121,870 has a problem in that a capacitance value between each extending conductor and IDC is seriously changed depending on an assembling tolerance, thereby not ensuring constant coupling. It can be considered as an alternative to decrease an assembling tolerance. However, if the assembling tolerance is too small, an assembling work becomes very difficult and parts should be prepared with very precise dimensions.

SUMMARY OF THE INVENTION

The present invention is designed to solve the problems of the prior art, and therefore it is an object of the present invention to provide a connecting block configured to ensure coupling between a terminal pin and a coupling pin by means of assembling of a side cover.

In one aspect of the present invention, there is provided a connecting block, including a housing having a plurality of slots extending from an upper surface thereof to an inside thereof with intervals; a plurality of terminal pins installed in the slots; a dielectric cover made of an insulating resin and coupled to the housing to cover a side of the housing; and a coupling pin electrically contacted with a terminal pin of any one pair among terminal pins belonging to different terminal pin pairs and extending opposite to a terminal pin of the other pair, wherein the coupling pin is molded in a body of the dielectric cover such that the insulating resin is interposed between the coupling pin and the terminal pin opposite to the coupling pin.

The connecting block may further include an auxiliary coupling pin contacted with a terminal pin, other than the terminal pin contacted with the coupling pin, among terminal pins belonging to the same terminal pin pair and extending in a direction opposite to an extending direction of the coupling pin to reduce alien crosstalk.

Preferably, a region of the coupling pin between a portion contacted with the terminal pin and a portion opposite to the terminal pin is bent to be relatively spaced more from the surface of the dielectric cover.

Also preferably, a portion of the coupling pin, contacted with the terminal pin, is exposed to the surface of the dielectric cover.

The coupling pin may have an elastic piece at a portion contacted with the terminal pin.

The terminal pin is preferably an IDC (Insulation Displacement Connection) pin.

According to the present invention, a capacitance value is not changed due to the structure in which a coupling pin is molded in a side cover, so it is possible to apply a constant amount of coupling to the connecting block.

In addition, the coupling pin is not integrated with the terminal pin, differently from the conventional art, and an electric contact between the coupling pin and the corresponding pin can be made only by coupling of the side cover, which ensures easy assembling and dissembling.

BRIEF DESCRIPTION OF THE DRAWINGS

Other objects and aspects of the present invention will become apparent from the following description of embodiments with reference to the accompanying drawing in which.

REFERENCE NUMERALS OF ESSENTIAL PARTS

| | |
|---|---|
| 100: housing | 101: slot |
| 102: IDC terminal pin | 103: dielectric cover |
| 104: coupling pin | 105: auxiliary coupling pin |

DESCRIPTION OF THE PREFERRED EMBODIMENT

Hereinafter, preferred embodiments of the present invention will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
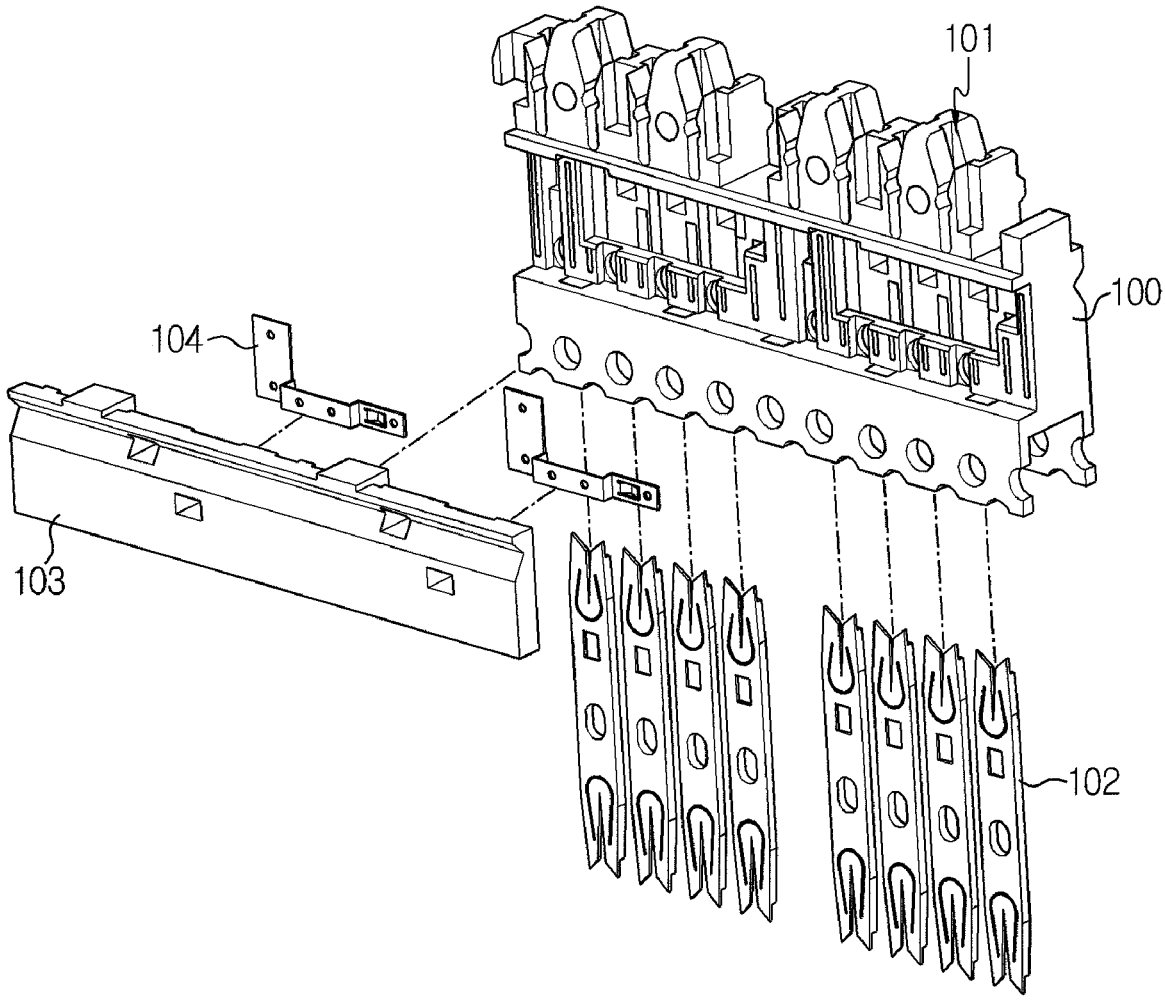
FIG. 1 is an exploded perspective view showing a connecting block according to one embodiment of the present invention.

FIG. 1 is an exploded perspective view showing a connecting block according to one embodiment of the present invention.

Referring to FIG. 1, the connecting block of this embodiment includes a housing 100 having a plurality of slots 101 at regular intervals, an IDC (Insulation Displacement Connection) terminal pin 102 inserted into the slot 101, and a dielectric cover 103 covering a side of the housing 100 and having a coupling pin 104.

The housing 100 may be provided as a single body by means of plastic injection molding. As an alternative, it is also possible that at least two sub housing are connected in series.

The plurality of slots 101 extend from an upper surface of the housing 100 to an inside thereof and are formed at regular intervals in the housing 100. Also, the IDC terminal pin 102 is installed to each slot 101.

The dielectric cover 103 is a side cover, which is detachably coupled to the side of the housing 100 to protect and fix a plurality of IDC terminal pins 102, and the dielectric cover 103 is made of an insulating resin. At the molding process using the insulating resin, at least one coupling pin 104 is molded in the dielectric cover 103. For the convenience, FIG. 1 illustrates that the coupling pin 104 is in a state separated out of the dielectric cover 103.

Figure 2:
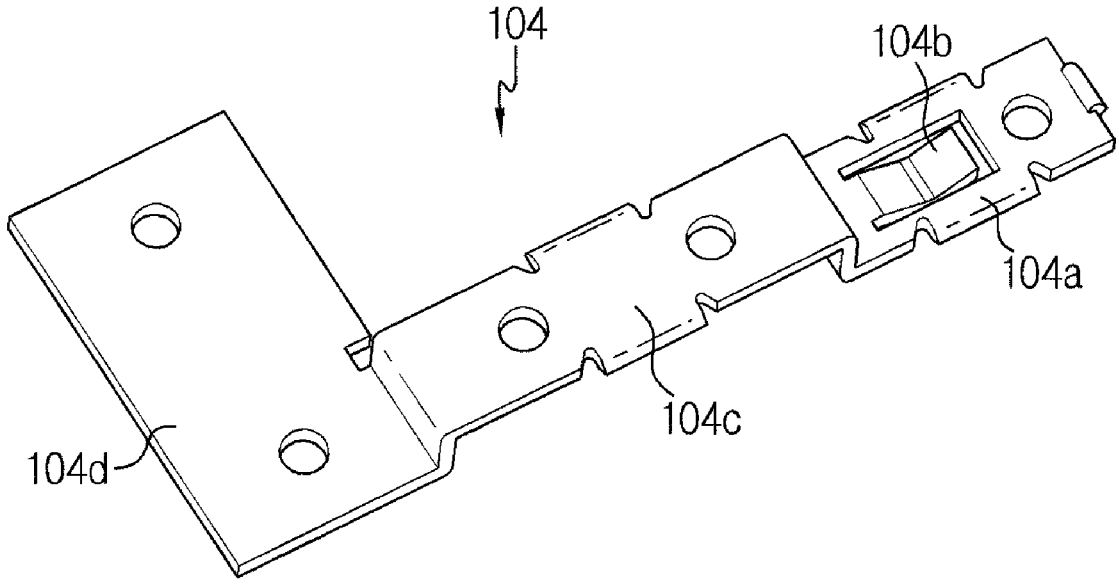
FIG. 2 is a detailed perspective view showing a coupling pin employed in the connecting block of FIG. 1.

As shown in FIG. 2 in detail, the coupling pin 104 includes a contact portion 104*a*, which is exposed to an inner surface of the dielectric cover 103 and makes an electric contact with a predetermined IDC terminal pin 102 when the dielectric cover 103 is coupled, an opposite portion 104*d* opposite with a predetermined gap to an IDC terminal 102 to be coupled, and a bending portion 104*c* bent toward the inside of the dielectric cover 103 as a region between the contact portion 104*a* and the opposite portion 104*d*. In the coupling pin 104, the shapes of the contact portion 104*a*, the opposite portion 104*d* and the bending portion 104*c* are not limited as illustrated, but they can be modified in various ways.

The contact portion 104*a* of the coupling pin 104 has an elastic piece 104*b* at a portion directly contacted with the IDC terminal pin 102. The elastic piece 104*b* is formed by cutting and bending processes. At the coupling of the dielectric cover 103, the contact portion 104*a* may be closely adhered to the corresponding IDC terminal pin 102 by means of the elastic piece 104*b*.

Figure 3:
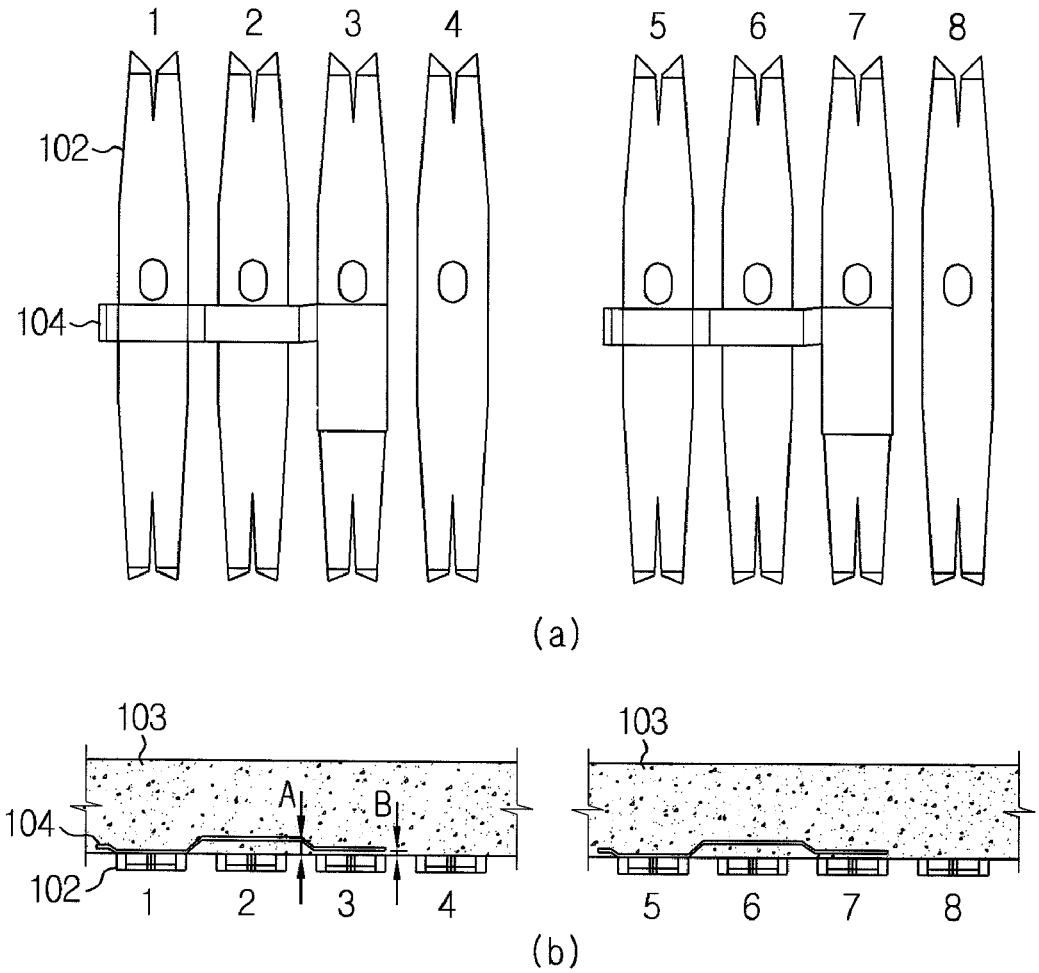
FIG. 3 shows an arrangement of an IDC terminal pin and the coupling pin, employed in FIG. 1, for illustrating their coupling relation.

As shown in FIG. 3, the coupling pin 104 is electrically contacted with an IDC terminal pin 102 of any one terminal pin pair among IDC terminal pins 102 belonging to different terminal pin pairs and extends in opposite to an IDC terminal pin 102 of the other pair. In (a) of FIG. 3, a side view of first and third IDC terminal pins 102 and fifth and seventh IDC terminal pins 102, respectively coupled by the coupling pin 104, is shown, and in (b) of FIG. 3, its plane view is shown.

As shown in (b) of FIG. 3, in the coupling pin 104, the opposite portion 104*d* is formed inwards toward the inside of the dielectric cover 103 as much as B based on the inner surface of the dielectric cover 103, so the opposite portion 104*d* is molded in the dielectric cover 103. This configuration gives an effect as if an insulating resin with a thickness of B is placed between the opposite portion 104*d* of the coupling pin 104 and the IDC terminal pin 102.

In the coupling pin 104, the bending portion 104*c* is bent to have a spacing distance A from the surface of the dielectric cover 103, compared with the spacing distance B of the opposite portion, thereby preventing IDC terminal pins 102 belonging to the same pair from being coupled.

In the connecting block configured as above, the coupling pin 104 is molded in the dielectric cover 103, so the coupling pin 104 is arranged to a suitable position by manipulating the dielectric cover 103 to be coupled to the side of the housing 100, so corresponding IDC terminal pins may be coupled in this way.

Also, due to the coupling of the dielectric cover 103, a capacitor structure in which a dielectric body made of an insulating resin is placed between the opposite portion 104*d* of the coupling pin 104 and the IDC terminal pin 102, so capacitance is not changed. In addition, since capacitance may be set high in an easy way, it is possible to reduce near-end crosstalk (NEXT) and far-end crosstalk (FEXT).

Figure 4:
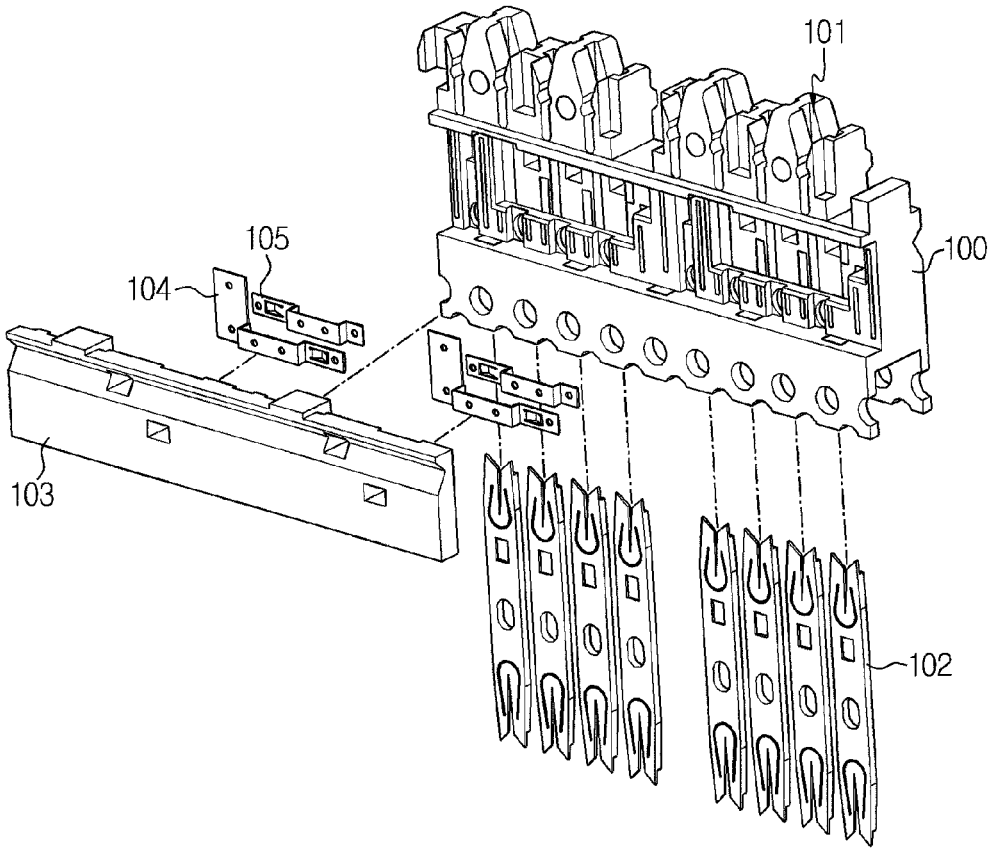
FIG. 4 is an exploded perspective view showing a connecting block according to another embodiment of the present invention.

FIG. 4 shows a connecting block according to another embodiment of the present invention. As shown in FIG. 4, the connecting block of this embodiment further includes an auxiliary coupling pin 105 for reducing alien crosstalk between adjacent blocks.

The auxiliary coupling pin 105 is contacted with an IDC terminal pin 102 among two terminal pins configuring an IDC terminal pin pair, except for an IDC terminal pin 102 contacted with the coupling pin 104. Also, the auxiliary coupling pin 105 extends in a direction opposite to an extending direction of the coupling pin 104 and reduces alien crosstalk.

Figure 5:
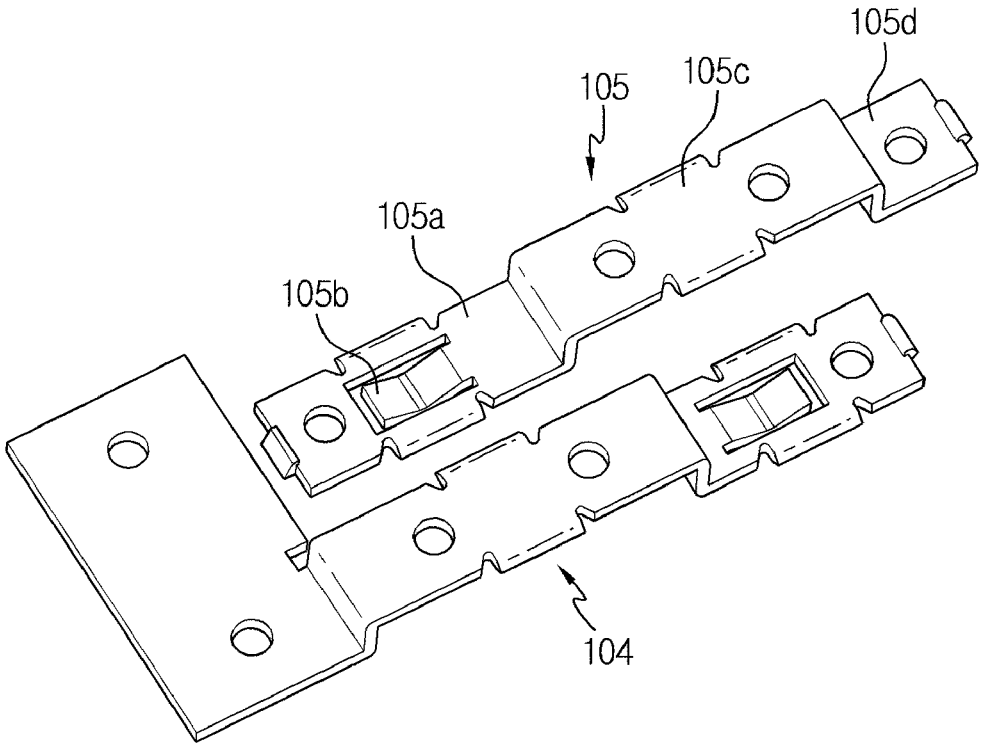
FIG. 5 is a detailed perspective view showing a coupling pin and an auxiliary coupling pin, employed in FIG. 4.

As shown in FIG. 5, the auxiliary coupling pin 105 includes a contact portion 105*a* electrically contacted with a predetermined IDC terminal pin 102 at the coupling of the dielectric cover 103, an opposite portion 105*d* opposite with a predetermined gap to the IDC terminal pin 102 to be coupled, and a bending portion 105*c* located between the contact portion 105*a* and the opposite portion 105*d* and bent into the dielectric cover 103. Here, the opposite portion 105*d* may be configured with different shapes, for example the same shape as the opposite portion 104*d* of the coupling pin 104, not limited to the illustrated shape. The contact portion 105*a* of the auxiliary coupling pin 105 has an elastic piece 105*b* formed by a cutting and bending process at a portion directly contacted with the IDC terminal pin 102.

Figure 6:
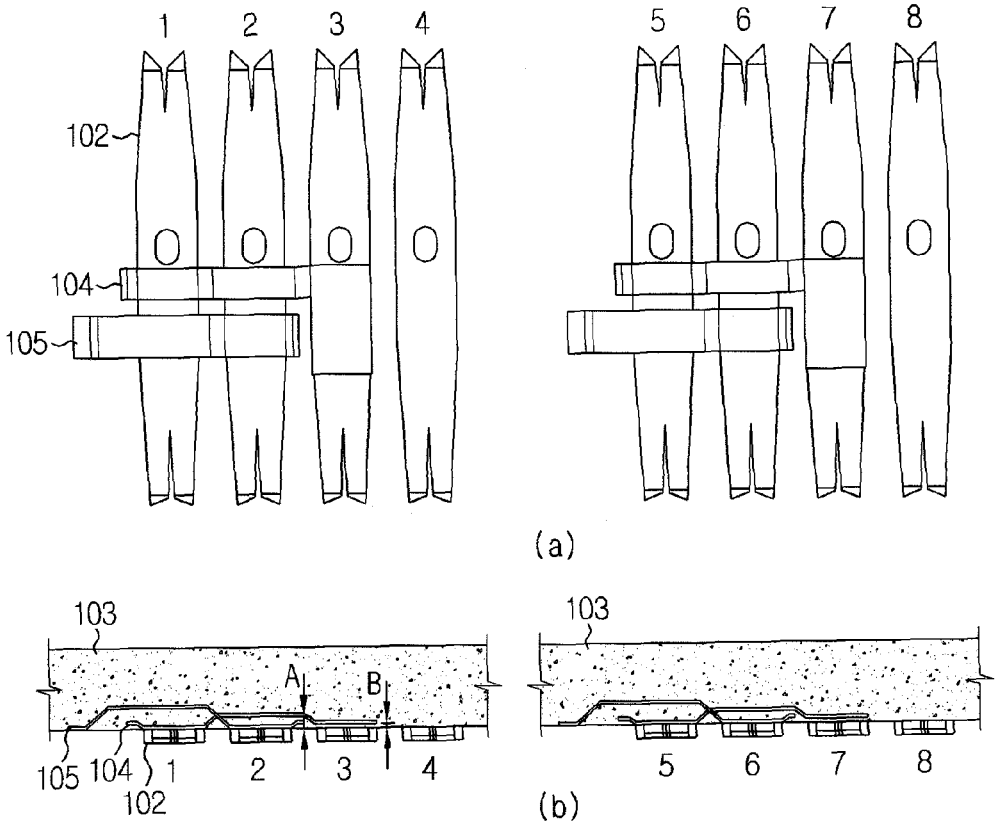
FIG. 6 shows an arrangement of an IDC terminal pin as well as the coupling pin and the auxiliary coupling pin, employed in FIG. 4, for illustrating their coupling relation.

The auxiliary coupling pin 105 is arranged to make a pair with the coupling pin 104, and the auxiliary coupling pin 105 extends in a direction opposite to the coupling pin 104 to reduce alien crosstalk. Seeing (a) of FIG. 6, there is a side view illustrating that first and third IDC terminal pins 102 are coupled to fifth and seventh IDC terminal pins 102 by means of the coupling pin 104, and a second IDC terminal and a sixth IDC terminal are coupled to an adjacent connecting block or an adjacent sub housing by means of the auxiliary coupling pin 105. Also, in (b) of FIG. 6, its plane view is shown.

Similarly to the coupling pin 104, the opposite portion 105*d* of the auxiliary coupling pin 105 is formed inwards toward the inside of the dielectric cover 103 based on an inner surface of the dielectric cover 103 and thus molded in the dielectric cover 103. This configuration may give an effect as if a dielectric body made of an insulating resin is placed between the opposite portion 105*d* of the auxiliary coupling pin 105 and the IDC terminal pin 102.

Since the coupling pin 104 and the auxiliary coupling pin 105 of the connecting block configured as above are molded in the dielectric cover 103, the coupling pin 104 and the auxiliary coupling pin 105 may be arranged at suitable locations by coupling the dielectric cover 103 to the side of the housing 100, thereby coupling corresponding IDC terminal pins.

Also, due to the coupling of the dielectric cover 103, a capacitor structure in which a dielectric body made of an insulating resin is placed between the IDC terminal pin 102 and the opposite portions 104*d*, 105*d* of the coupling pin 104 and the auxiliary coupling pin 105, so it is possible to keep capacitance unchanged and set capacitance to a high level in an easy way. Thus, near-end crosstalk (NEXT) and far-end crosstalk (FEXT) between the IDC terminal pins 102 can be effectively reduced by means of the coupling pin 104, and also alien crosstalk (ANEXT) between blocks can also be effectively reduced by means of the auxiliary coupling pin 105.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

APPLICABILITY TO THE INDUSTRY

The connecting block of the present invention may effectively reduce near-end crosstalk (NEXT) between terminal pins and far-end crosstalk (FEXT) between blocks, which may accordingly meet cat.6A standards as well as cat.6 standards for high-rate communication.

What is claimed is:

1. A connecting block, comprising:

a housing having a plurality of slots extending from an upper surface thereof to an inside thereof with intervals;

a plurality of terminal pin pairs installed in the slots;

a dielectric cover made of an insulating resin and coupled to the housing to cover a side of the housing; and a coupling pin electrically contacting a first terminal pin of any one pair of the plurality of terminal pin pairs and extending to face a second terminal pin of another pair of the plurality of terminal pin pairs, wherein the coupling pin is molded in a body of the dielectric cover such that the insulating resin is interposed between the coupling pin and the second terminal pin facing the coupling pin.

2. The connecting block according to claim 1, further comprising an auxiliary coupling pin contacting a third terminal pin of said any one pair of the plurality of terminal pin pairs, which does not contact the coupling pin and extending in a direction opposite to an extending direction of the coupling pin to reduce alien crosstalk.

3. The connecting block according to claim 1, wherein a region of the coupling pin between a portion contacted with the first terminal pin and a portion opposite to the second terminal pin is bent to be relatively spaced more from the surface of the dielectric cover.

4. The connecting block according to claim 1, wherein a portion of the coupling pin, contacted with the first terminal pin, is exposed to the surface of the dielectric cover.

5. The connecting block according to claim 4, wherein the coupling pin has an elastic piece at a portion contacted with the first terminal pin.

6. The connecting block according to claim 1, wherein the plurality of terminal pin pairs comprises an IDC (Insulation Displacement Connection) pin.

* * * * *